US011491518B2

(12) United States Patent
Nakajima

(10) Patent No.: US 11,491,518 B2
(45) Date of Patent: Nov. 8, 2022

(54) AIR INTAKE AND BLOWOUT TOOL

(71) Applicant: KYOKUTOH CO., LTD., Aichi (JP)

(72) Inventor: Kotaro Nakajima, Aichi (JP)

(73) Assignee: Kyokutoh Co., Ltd., Aichi (JP)

( * ) Notice: Subject to any disclaimer, the term of this patent is extended or adjusted under 35 U.S.C. 154(b) by 758 days.

(21) Appl. No.: 16/424,017

(22) Filed: May 28, 2019

(65) Prior Publication Data

US 2019/0275567 A1 Sep. 12, 2019

Related U.S. Application Data

(63) Continuation of application No. PCT/JP2017/034093, filed on Sep. 21, 2017.

(30) Foreign Application Priority Data

Nov. 29, 2016 (JP) ..... JP2016-231456

(51) Int. Cl.

| | |
|---|---|
| ***B08B 5/02*** | (2006.01) |
| ***B08B 5/04*** | (2006.01) |
| ***F04F 5/20*** | (2006.01) |
| ***F04F 5/46*** | (2006.01) |
| ***B05B 1/00*** | (2006.01) |

(Continued)

(52) U.S. Cl.

CPC ..... *B08B 5/02* (2013.01); *B05B 1/005* (2013.01); *B05B 1/06* (2013.01); *B05B 7/0087* (2013.01);

(Continued)

(58) Field of Classification Search

None

See application file for complete search history.

(56) References Cited

U.S. PATENT DOCUMENTS 3,664,768 A 5/1972 Mays et al.
3,795,367 A * 3/1974 Mocarski ..... B05B 7/0416 417/198

(Continued)

FOREIGN PATENT DOCUMENTS

CN 106062380 A 10/2016
GB 1 431 810 A 4/1976

(Continued)

OTHER PUBLICATIONS

W02016088154 English Translation, accessed on Mar. 2022. (Year: 2016).*

(Continued)

*Primary Examiner* — Eric W Golightly
*Assistant Examiner* — Arlyn I Rivera-Cordero
(74) *Attorney, Agent, or Firm* — Ruggiero, McAllister & McMahon LLC

(57) ABSTRACT

A compressed air introduction part (5) capable of introducing compressed air into an air passage (2*a*) of a cylinder body (2) is provided. The compressed air introduction part (5) has a compressed air exit port (5*a*) formed in the shape of a ring that extends circumferentially about a cylinder-center axis (C1) of the cylinder body (2). An annular protuberance surface portion (30) is formed on an inner circumferential surface forming the air passage (2*a*) on an air blowout port (2*c*) side of the compressed air exit port (5*a*), and a protuberance surface (30*a*) of the annular protuberance surface portion (30) is shaped so as to extend from a peripheral edge portion of the air blowout port (2*c*) side of the compressed air exit port (5*a*) along the radial direction of the cylinder body (2) and to then gradually curve and extend toward the air blowout port (2*c*) side.

3 Claims, 3 Drawing Sheets

(51) Int. Cl.

| | |
|---|---|
| ***B05B 1/06*** | (2006.01) |
| ***B05B 7/00*** | (2006.01) |
| ***B05B 7/06*** | (2006.01) |

(52) U.S. Cl.

CPC ..... *B08B 5/04* (2013.01); *F04F 5/20* (2013.01); *F04F 5/46* (2013.01); *B05B 7/06* (2013.01)

(56) References Cited

U.S. PATENT DOCUMENTS

| | | | |
|---|---|---|---|
| 6,604,694 | B1 | 8/2003 | Kordas et al. |
| 7,354,029 | B1 | 4/2008 | Rutstein |
| 10,309,422 | B2 | 6/2019 | Kondou et al. |

FOREIGN PATENT DOCUMENTS

| | | | |
|---|---|---|---|
| GB | 2 077 356 | A | 12/1981 |
| JP | 2008-115847 | A | 5/2008 |
| WO | 2008-054107 | A1 | 5/2008 |
| WO | 2016/088154 | A1 | 6/2016 |
| WO | 2016088154 | A1 | 6/2016 |

OTHER PUBLICATIONS

Canadian Office Action dated Jul. 8, 2020 from corresponding Canadian Patent Application No. 3,044,363, 3 pages.

Korean Notification of Reason for Refusal dated Oct. 20, 2020 from corresponding Korean Patent Application No. 10-2019-7017940, 6 pages.

Circiu et al.; "Gas Turbine Mixed Jet Flows Based on the Coanda Effect"; Review of the Air Force Academy, No. 3 (30) 2015, pp. 27-32.

Nexflow, Nex Flow Air Products Corp, Adjustable Air Amplifier, Mar. 21, 2011, YouTube, youtube.com/watch?v=-CtDurA5Tnw (Accessed: Oct. 27, 2020), 1 page.

Nex Flow, Nex Flow Air Products Corp, Ion Beam Blaster By Nex Flow™ Air Products, Apr. 23, 2014, YouTube, youtube.com/watch?v=m-ddFNUUe8 (Accessed: Oct. 27, 2020), 1 page.

Japanese Office Action dated Apr. 23, 2020 from corresponding Japanese Patent Application No. 2016-231456, 8 pages.

Extended European Search Report dated Oct. 19, 2019 from corresponding European Patent Application No. 17877218.2, 7 pages.

International Search Report dated Nov. 28, 2017 from corresponding International (PCT) patent application No. PCT/JP2017/034093, 3 pages.

Written Opinion dated Nov. 28, 2017 from corresponding International (PCT) patent application No. PCT/JP2017/034093, 4 pages.

Korean First Office Action dated Mar. 10, 2020 from corresponding Korean Patent Application No. 10-2019-7017940, 9 pages.

Chinese First Office Action dated Jan. 15, 2020 from corresponding Chinese Patent Application No. 201780072065.9, 13 pages.

* cited by examiner

AIR INTAKE AND BLOWOUT TOOL

CROSS-REFERENCE TO RELATED APPLICATION

This application is a continuation of International Application No. PCT/JP2017/034093 filed on Sep. 21, 2017, which is incorporated herein by reference in its entirety and for all purposes.

TECHNICAL FIELD

The present disclosure relates to an air intake and blowout tool allowing intake or blowout operation by introducing compressed air into the tool in the shape of a cylinder and thereby generating a high volume of air flow inside the tool along the central axis of the cylinder.

BACKGROUND OF DISCLOSURE

Generally, in manufacturing plants, etc., operations to scatter away swarf and water drops sticking on equipment or to collect dust and waste produced in a plant are performed, for example, using an air intake and blowout tool disclosed in International Publication WO2016/088154. The air intake and blowout tool has a cylinder body including along the central axis of the cylinder an air passage allowing air to flow through. The cylinder body has openings on one end thereof that constitutes an air intake port and on an opposite end thereof that constitutes an air blowout port. A compressed air introduction part for introducing into the air passage compressed air pressurized by a compressor (now shown) is provided in a midsection of the cylinder body. The compressed air introduction part has a shape extending annularly around the central axis of the cylinder. The compressed air introduction part introduces compressed air into the air passage toward an air blowout port side of the air passage to generate negative pressure in the air passage on an air intake port side thereof and thereby produce an air flow in the air passage. Air is thus sucked in the air passage from the air intake port and blown out from the air blowout port. Therefore, it is possible to perform operations on one hand for scattering away swarf and water drops by utilizing the air blowout port side of the air intake and blowout tool and on the other hand for sucking and collecting dust and waste by utilizing the air intake port side of the air intake and blowout tool.

In the air intake and blowout tool as shown in International Publication WO2016/088154, it is considered that joining smoothly the air flowing in the air passage and the compressed air introduced into the air passage from a compressed air exit port of the compressed air introduction part can reduce energy loss around the compressed air exit port in the air passage and increase a volume flow rate of the air in the air passage. Thus, the compressed air introduction part has been generally seen to be favorable to have a shape decreasing in diameter and gradually closer to the central axis of the cylinder toward the air blowout port side to open into an inner circumferential surface of the cylinder body.

SUMMARY

In this respect, the inventor has found, as a result of diligent study, that when the compressed air introduction part has the shape as described above, the cylinder body inner circumferential surface forming the compressed air exit port on the air intake port side has a pointy shape to be progressively thinner toward the air blowout port side, so that small volume of the compressed air introduced from the compressed air exit port into the air passage flows so as to turn around along a portion of the pointy shape and thus advances toward the air intake port side of the air passage, causing the energy loss at the portion of the pointy shape.

To address this, it is conceivable to position a peripheral edge portion of the air intake port side of the compressed air exit port as close to the air intake port as possible, in order to avoid the pointy cross-sectional shape of the air intake port side of the cylinder body inner circumferential surface that forms the compressed air exit port. In so doing, the compressed air exit port of the compressed air introduction part becomes wider and thereby a flow rate of the compressed air introduced in the air passage from the compressed air introduction part is lowered, resulting in a reduced volume flow rate of the air in the air passage.

Therefore, an object of the present disclosure is to provide an air intake and blowout tool able to increase intake and blowout volume.

To achieve the object, the present disclosure is characterized by introducing compressed air into an air passage by applying the Coanda effect.

Specifically, the present disclosure is directed to an air intake and blowout tool including a cylinder body that includes along a cylinder-central axis an air passage having an air intake port on one end and an air blowout port on another end; and, in a midsection of the cylinder body, a compressed air introduction part capable of introducing compressed air into the air passage; the compressed air introduction part configured to introduce compressed air into the air passage toward an air blowout port side of the air passage to generate negative pressure in the air passage on an air intake port side thereof and thereby produce an air flow in the air passage, and thus providing air being sucked from the air intake port into the air passage and blown out from the air blowout port. The following solutions are then applied.

According to a first aspect of the present disclosure, the compressed air introduction part includes a compressed air exit port formed in a shape of a ring that extends circumferentially about the cylinder-central axis and slot-shaped extending straight along a radial direction of the cylinder body to open into the air passage. An air passage forming inner circumferential surface of the cylinder body on an air blowout port side of the compressed air exit port includes an annular protuberance surface portion protruding toward a radially inner side of the cylinder body greater than an air passage forming inner circumferential surface on an air intake port side of the compressed air exit port and extending circumferentially about the cylinder central axis. The annular protuberance surface portion includes a protuberance surface shaped to extend from a peripheral edge portion of the air blowout port side of the compressed air exit port toward the radially inner side of the cylinder body and to then gradually curve and extend toward the air blowout port side.

According to a second aspect of the present disclosure which is an embodiment of the first aspect of the disclosure, the air passage forming inner circumferential surface of the cylinder body on the air intake port side of the compressed air exit port includes an annular stepped surface portion extending along a peripheral edge portion of the air intake port side of the compressed air exit port.

According to a third aspect of the present disclosure which is an embodiment of the first or second aspect of the disclosure, the cylinder body includes first and second cylinder members each open at both ends. The cylinder body is configured to be assembled by inserting one end side of the first cylinder member into an interior of the second cylinder member to screw one end side of the second cylinder member with an outer circumferential surface of a midsection of the first cylinder member. The compressed air introduction part is configured to be formed of a portion surrounded by an outer circumferential surface of the one end side of the first cylinder member and an inner circumferential surface of a midsection of the second cylinder member.

According to a fourth aspect of the present disclosure which is an embodiment of the third aspect of the disclosure, the inner circumferential surface of the midsection of the second cylinder member includes an annular face extending along a direction orthogonal to the cylinder-central axis and opposing one end face of the first cylinder member. The compressed air exit port is configured to be formed between the one end face of the first cylinder member and the annular face.

In the first aspect of the present disclosure, the compressed air introduced in the compressed air introduction part is then introduced from the compressed air exit port to the air passage in an interior of the cylinder body to advance linearly toward the radially inner side of the cylinder body. While the annular protuberance surface portion is provided on the air blowout port side of the compressed air exit port, no wall is provided on the air intake port side of the compressed air exit port. Thus, the compressed air introduced from the compressed air exit port into the air passage flows smoothly along the protuberance surface of the annular protuberance surface portion toward the air blowout port side due to the Coanda effect. In this manner, the compressed air is introduced into the air passage to be directed toward the air blowout port side of the air passage, thus resulting in producing the air flow in the air passage. The compressed air exit port is slot-shaped extending toward the radial direction of the cylinder body and thus the cross-sectional shape of the cylinder body inner circumferential surface forming the compressed air exit port on the air intake port side is not acute angled. The phenomenon that a part of the compressed air introduced from the compressed air exit port into the air passage advances toward the air intake port is less likely to occur. This enables reduced energy loss around the compressed air exit port and increased volume flow rate of the air in the air passage. The compressed air exit port does not need to be wider and thus the flow rate of the compressed air introduced from the compressed air introduction part into the air passage is not reduced. Moreover, the cylinder body inner circumferential surface on the air intake port side of the compressed air exit port is positioned radially outwards from the cylinder body inner circumferential surface on the air blowout port side. The air intake port is thus designed to have a larger diameter, enabling increased air intake volume in the air intake port.

In the second aspect of the present disclosure, even if a part of the compressed air introduced from the compressed air exit port into the air passage advances toward the air intake port side, its flow stays at a portion corresponding to the annular stepped surface portion and is less likely to prevent the air flow in the air passage. This enables further reduced energy loss around the compressed air exit port and increased volume flow rate of the air in the air passage.

In the third aspect of the present disclosure, circumferential walls of the first and second cylinder members are placed over one another at a midsection of the assembled air intake and blowout tool, resulting in the air intake and blowout tool having high rigidity. The air intake and blowout tool then consists only of two components, allowing shorter assembly time to reduce assembly cost.

In the fourth aspect of the present disclosure, when the first and second cylinder members are assembled, a gap formed between the first and second cylinder members serves as the compressed air exit port of the compressed air introduction part. The first and second cylinder members thus do not require preceding machining processes to form holes or grooves for a compressed air exit port, enabling lower machining cost.

DETAILED DESCRIPTION

Embodiments of the present disclosure will now be described with reference to the drawings. It is noted that the following description of preferred embodiments is merely an example in nature.

Figure 1:
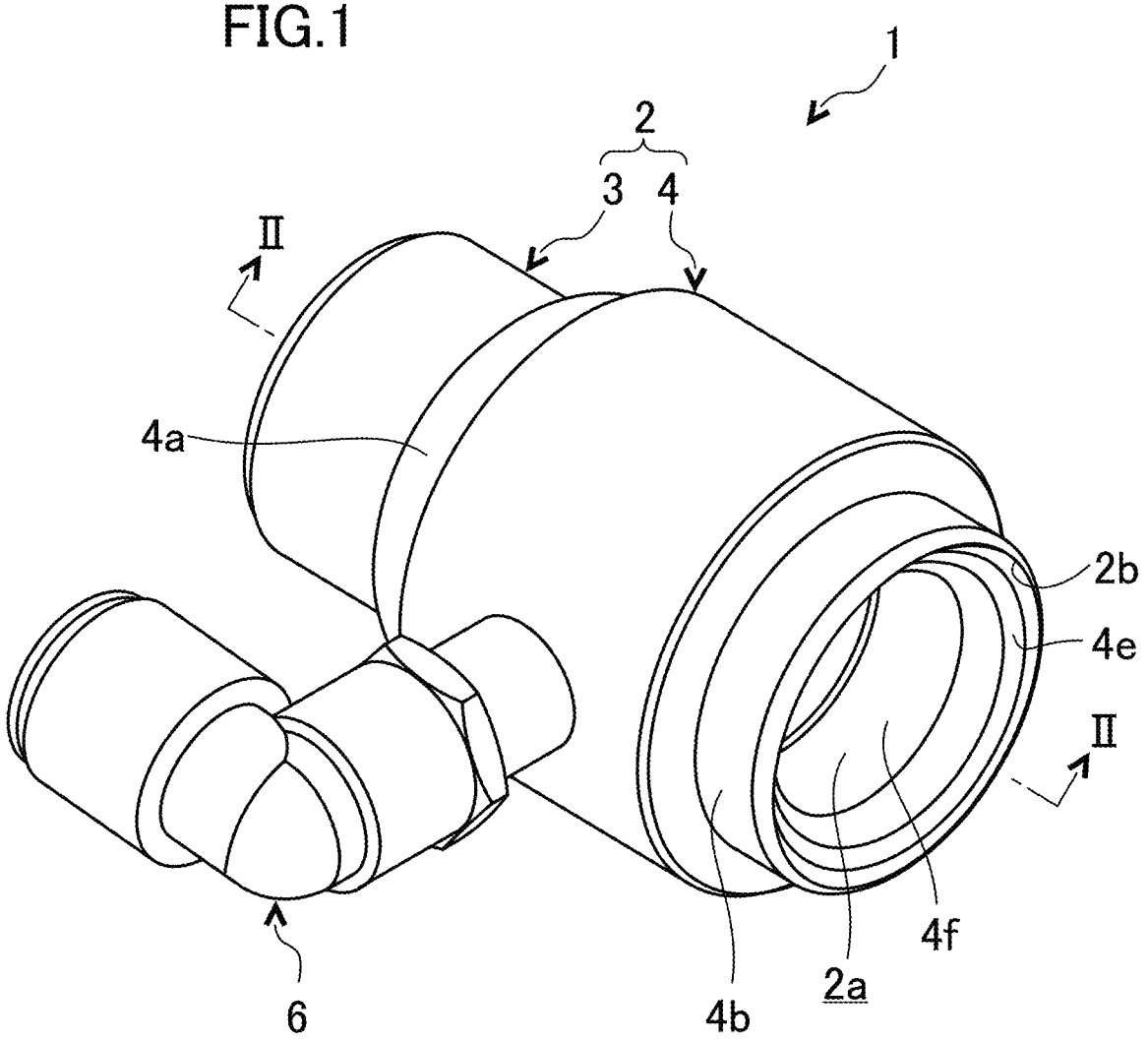
FIG. 1 is a perspective view illustrating an air intake and blowout tool according to embodiments of the present disclosure.

FIG. 1 illustrates an air intake and blowout tool 1 according to embodiments of the present disclosure. The air intake and blowout tool 1 converts compressed air generated by a compressor (not shown) to a high-volume air flow, and is utilized for operations to scatter away swarf and water drops sticking on equipment by blowing the air and to suck in and collect dust and waste produced in a plant by using the air.

The air intake and blowout tool 1 includes a cylinder body 2 having, along a cylinder central axis C1, an air passage 2*a* that allows air to flow inside. The air passage 2*a* has an opening on one end that forms an air intake port 2*b* and an opening on another end that forms an air blowout port 2*c*.

Figure 2:
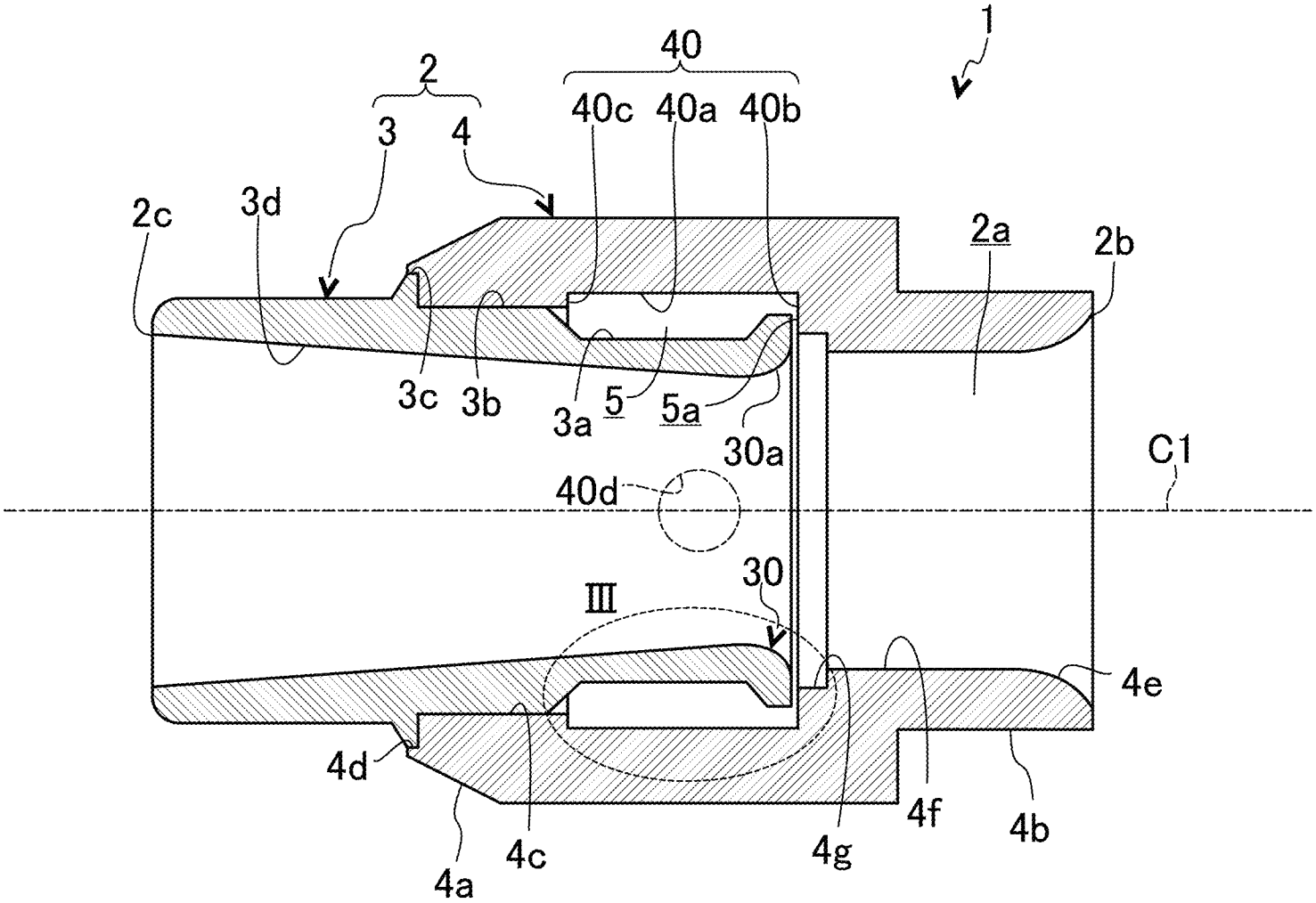
FIG. 2 is a cross-sectional view taken along the plane II-II shown in FIG. 1.
Figure 3:
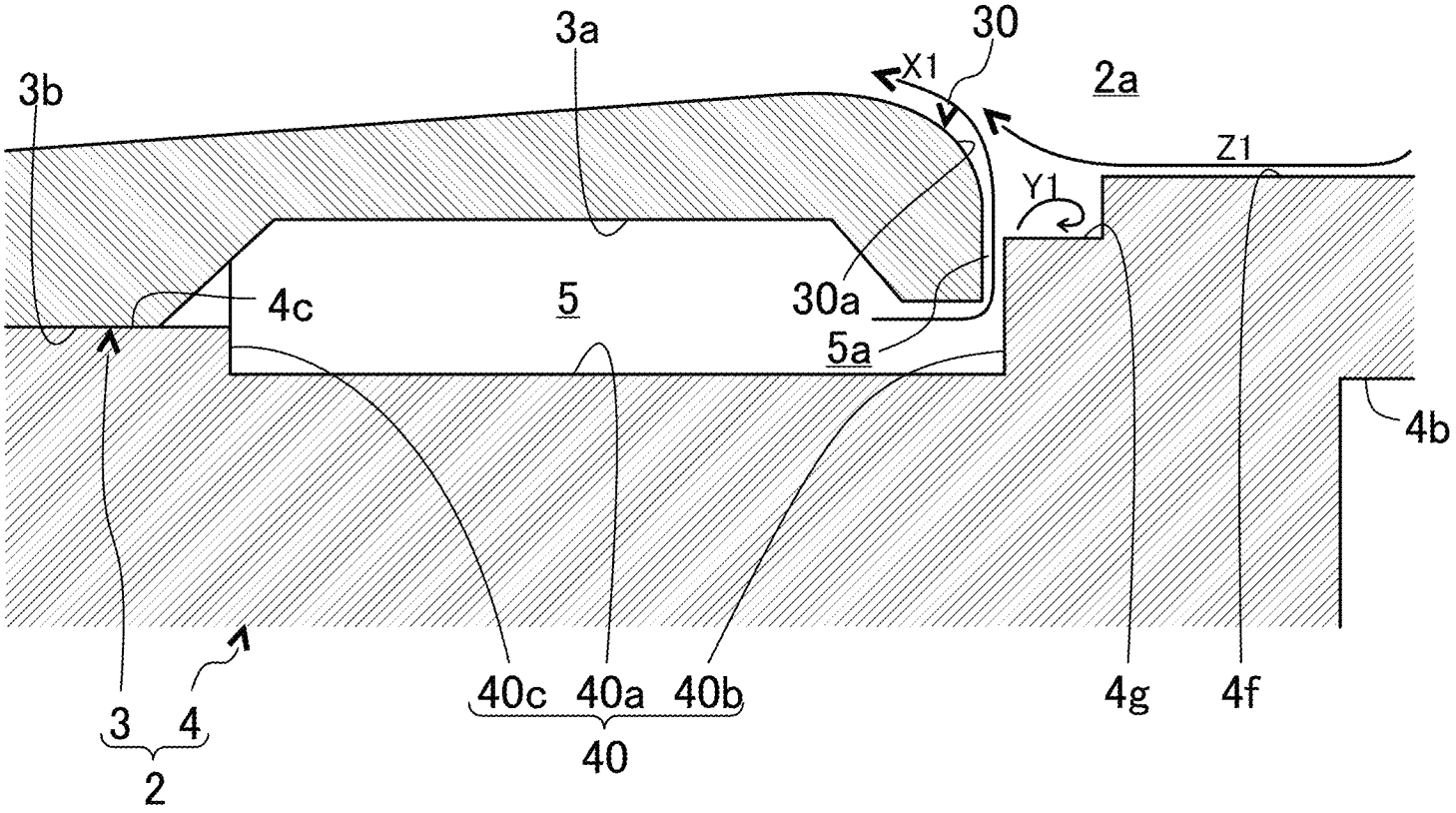
FIG. 3 is an enlarged view of a portion indicated as the part III shown in FIG. 2.

As illustrated in FIGS. 2 and 3, the cylinder body 2 includes first and second cylinder members 3, 4 each open at both ends.

A first recessed groove 3*a* is formed on an outer circumferential surface of the first cylinder member 3 on one end side thereof and has an annular shape extending circumferentially about the cylinder central axis C1. The first recessed groove 3*a* is shaped to have a wider groove width and to be shallow.

A male thread portion 3*b* is formed continuously with the first recessed groove 3*a* and on the outer circumferential surface of the first cylinder member 3 at a midsection thereof.

An annular rib portion 3*c* is also formed continuously with the male thread portion 3*b* and on the outer circumferential surface of the first cylinder member 3 at the midsection thereof. The annular rib portion 3*c* protrudes radially outwardly and extends circumferentially about the cylinder central axis C1.

An annular protuberance surface portion 30 is formed on an inner circumferential surface of the first cylinder member 3 on the one end side thereof. The annular protuberance surface portion 30 projects toward a radially inner side of the cylinder body 2 and extends circumferentially about the cylinder central axis C1.

The annular protuberance surface portion 30 includes a protuberance surface 30*a* formed to extend from one end face of the first cylinder member 3 (a peripheral edge portion of a compressed air exit port 5*a* on an air blowout port 2*c* side, as described below) toward the radially inner side of the cylinder body 2 and to then gradually curve and extend toward another end side of the first cylinder member 3.

A blowout port side air guiding surface 3*d* continuous with the protuberance surface 30*a* is formed on a portion extending from a midsection of the inner circumferential surface of the first cylinder member 3 to the other end thereof. The blowout port side air guiding surface 3*d* is tapered to increase gradually in diameter in a direction away from the protuberance surface 30*a*.

A tapered surface 4*a* is formed on an outer circumferential surface of the second cylinder member 4 on one end side thereof. The tapered surface 4*a* gradually decreases in diameter toward the one end.

On the other hand, an annular mounting face 4*b* is formed on the outer circumferential surface of the second cylinder member 4 on another end side thereof. The annular mounting face 4*b* is recessed in the shape of a step and extends along a peripheral edge portion of an opening of the other end. A surface of the annular mounting face 4*b* has a thread portion that is not shown.

An annular second recessed groove 40 extending circumferentially about the cylinder central axis C1 is formed on an inner circumferential surface of the second cylinder member 4 at a midsection thereof. The second recessed groove 40 is shaped to have a wider groove width and to be shallow.

The second recessed groove 40 includes a belt-shaped bottom surface 40*a* extending circumferentially in an annular manner about the cylinder central axis C1, a first annular face 40*b* extending from one edge of the belt-shaped bottom surface 40*a* in a direction orthogonal to the cylinder-central axis C1, and a second annular face 40*c* extending from another edge of the belt-shaped bottom surface 40*a* in the direction orthogonal to the cylinder-central axis C1.

A compressed air introduction hole 40*d* opening in the belt-shaped bottom surface 40*a* of the second recessed groove 40 is formed penetrating at the midsection of the second cylinder member 4. The compressed air introduction hole 40*d* is coupled to an L-shaped pipe 6 (see FIG. 1).

A female thread portion 4*c* is formed continuously with the second recessed groove 40 and on the inner circumferential surface of the second cylinder member 4 on the one end side thereof. The female thread portion 4*c* can be screwed with the male thread portion 3*b*.

An annular fitting portion 4*d* corresponding to the annular rib portion 3*c* is formed in a portion continuous with the female thread portion 4*c* on the inner circumferential surface of the second cylinder member 4 on the one end side thereof.

On the other hand, a tapered air intake surface 4*e* and an intake port side air guiding surface 4*f* formed continuously with the air intake surface 4*e* are provided on the inner circumferential surface of the second cylinder member 4 on the other end side thereof. The air intake surface 4*e* decreases gradually in diameter from the peripheral edge portion of the opening of the other end of the second cylinder member 4 toward an interior thereof. The intake port side air guiding surface 4*f* extends lineally along a cylinder central axis of the second cylinder member 4 toward the one end side of the second cylinder member 4. An annular stepped surface portion 4*g* extending along a peripheral edge portion of an opening of the second recessed groove 40 is formed on the intake port side air guiding surface 4*f* on the one end side of the second cylinder member 4.

The cylinder body 2 is then assembled by inserting the one end side of the first cylinder member 3 into the interior of the second cylinder member 4 through the one end side of the second cylinder member 4 and screwing the male thread portion 3*b* of the first cylinder member 3 with the female thread portion 4*c* of the second cylinder member 4 until the annular rib portion 3*c* is fitted with the annular fitting portion 4*d*.

When the first and second cylinder members 3, 4 are assembled, the first recessed groove 3*a* and the second recessed groove 40 oppose each other and a portion surrounded by the first recessed groove 3*a* and the second recessed groove 40 forms a compressed air introduction part 5 of the present disclosure.

In the assembled first and second cylinder members 3, 4, one end face of the first cylinder member 3 opposes the first annular face 40*b* and a gap formed between the one end face of the first cylinder member 3 and the first annular face 40*b* serves as a compressed air exit port 5*a* of the present disclosure.

Thus, the compressed air exit port 5*a* has a shape in a ring extending circumferentially about the cylinder central axis C1 and is slot-shaped extending straight in the radial direction of the cylinder body 2 so as to open into the air passage 2*a*. The annular protuberance surface portion 30 is formed to protrude toward the radially inner side of the cylinder body 2 greater than the intake port side air guiding surface 4*f* on the air intake port 2*b* side of the compressed air exit port 5*a*. The annular stepped surface portion 4*g* is then formed to extend along a peripheral edge portion of the compressed air exit port 5*a* on the air intake port 2*b* side thereof.

The compressed air introduction part 5 then introduces compressed air through the compressed air exit port 5*a* into the air passage 2*a*. In the present disclosure, the compressed air is introduced to advance linearly from the compressed air exit port 5*a* to the air passage 2*a* of the interior of the cylinder body 2 toward the radially inner side of the cylinder body 2. While the annular protuberance surface portion 30 is provided on the air blowout port 2*c* side of the compressed air exit port 5*a*, no wall is provided on the air intake port 2*b* side of the compressed air exit port 5*a*. Thus, the compressed air introduced from the compressed air exit port 5*a* into the air passage 2*a* flows smoothly along the protuberance surface 30*a* of the annular protuberance surface portion 30 toward the air blowout port 2*c* side due to the Coanda effect, as illustrated by the allow X1 shown in FIG. 3. In this manner, the compressed air is introduced into the air passage to direct toward the air blowout port side thereof, thus causing the generation of an air flow in the air passage 2*a*. In doing so, the compressed air exit port 5*a* extends radially to be slot shaped and a cross-sectional shape of the cylinder body 2 inner circumferential surface forming the compressed air exit port 5*a* on the air intake port 2*b* side is thus not acute angled. The phenomenon that a part of the compressed air introduced from the compressed air exit port 5*a* into the air passage 2*a* advances toward the air intake port 2*b* side is less likely to occur. This enables reduced energy loss around the compressed air exit port 5*a* and increased volume flow rate of the air in the air passage 2*a*. The compressed air exit port 5*a* then does not need to be wider and thus the flow rate of the compressed air introduced from the compressed air introduction part 5 into the air passage 2*a* is not reduced. Moreover, the cylinder body 2 inner circumferential surface on the air intake port 2*b* side of the compressed air exit port 5*a* is positioned radially outwards from the cylinder body 2 inner circumferential surface on the air blowout port 2*c* side. The air intake port 2*b* is thus designed to have a larger diameter, enabling increased air intake volume in the air intake port 2*b*.

Then, even if a part of the compressed air introduced from the compressed air exit port 5*a* into the air passage 2*a* advances toward the air intake port 2*b* side, its flow stays at a portion corresponding to the annular stepped surface portion 4*g*, as illustrated by the arrow Y1 in FIG. 3, to be less likely to prevent the air flow in the air passage 2*a* (the arrow Z1 in FIG. 3). This enables further reduced energy loss around the compressed air exit port 5*a* and increased volume flow rate of the air in the air passage 2*a*.

In addition, circumferential walls of the first and second cylinder members 3,4 are placed over one another at a midsection of the assembled air intake and blowout tool 1, resulting in the highly rigid air intake and blowout tool 1. The air intake and blowout tool 1 then consists only of two components, allowing shorter assembly time to reduce assembly cost.

Additionally, as the first and second cylinder members 3, 4 are assembled, a gap formed between the first and second cylinder members 3, 4 serves as the compressed air exit port 5*a* of the compressed air introduction part 5, so that the first and second cylinder members 3, 4 do not require preceding machining processes to form holes or grooves for a compressed air exit port 5*a*, enabling lower machining cost.

The present disclosure is suitable for an air intake and blowout tool having a cylinder shape and allowing intake or blowout operation by introducing compressed air into the tool and thereby generating a high volume of air flow inside the tool along the central axis of the cylinder.

The invention claimed is:

1. An air intake and blowout tool comprising:

a cylinder body that includes along a cylinder-central axis an air passage having an air intake port on one end and an air blowout port on another end, and, in a midsection of the cylinder body, a compressed air introduction part capable of introducing compressed air into the air passage, the compressed air introduction part configured to introduce compressed air into the air passage toward an air blowout port side of the air passage to generate negative pressure in the air passage on an air intake port side thereof and thereby produce an air flow in the air passage, and thus providing air being sucked from the air intake port into the air passage and blown out from the air blowout port, wherein:

the compressed air introduction part includes a compressed air exit port formed in a shape of ring that extends circumferentially about the cylinder-central axis, and slot-shaped extending straight along a radial direction of the cylinder body to open into the air passage;

the cylinder body has a first air passage that forms an inner circumferential surface of the cylinder body on an air intake port side that includes an intake port side air guiding surface extending along the cylinder-central axis and a second air passage forming inner circumferential surface of the cylinder body on an air blowout port side of the compressed air exit port that includes an annular protuberance surface portion protruding toward a radially inner side of the cylinder body greater than an air passage forming inner circumferential surface on an air intake port side of the compressed air exit port, and extending circumferentially about the cylinder-central axis;

the annular protuberance surface portion includes a protuberance surface shaped to extend from a peripheral edge portion of the air blowout port side of the compressed air exit port toward the radially inner side of the cylinder body and to then gradually curve and extend toward the air blowout port side; and the compressed air exit port and the intake port side air guiding surface on the air passage inner circumferential surface of the cylinder body have a continuous portion therebetween that includes an annular stepped surface portion recessed in an L-shape in cross-sectional view and extending along a peripheral edge portion of the air intake port side of the compressed air exit port.

2. The air intake and blowout tool of claim 1, wherein the cylinder body includes first and second cylinder members each open at both ends, and is configured to be assembled by inserting one end side of the first cylinder member into an interior of the second cylinder member to screw one end side of the second cylinder member with an outer circumferential surface of a midsection of the first cylinder member; and wherein the compressed air introduction part is configured to be formed of a portion surrounded by an outer circumferential surface of the one end side of the first cylinder member and an inner circumferential surface of a midsection of the second cylinder member.

3. The air intake and blowout tool of claim 2, wherein the inner circumferential surface of the midsection of the second cylinder member includes an annular face extending along a direction orthogonal to the cylinder-central axis and opposing one end face of the first cylinder member, and wherein the compressed air exit port is configured to be formed between the one end face of the first cylinder member and the annular face.

* * * * *